United States Patent [19]

Daane

[11] 4,197,973

[45] Apr. 15, 1980

[54] HIGH VELOCITY WEB FLOATING AIR BAR HAVING AIR FLOW STRAIGHTENING MEANS FOR AIR DISCHARGE SLOT MEANS

[75] Inventor: Robert A. Daane, Green Bay, Wis.

[73] Assignee: W. R. Grace & Co., New York, N.Y.

[21] Appl. No.: 950,745

[22] Filed: Oct. 12, 1978

[51] Int. Cl.[2] ..... B65H 17/32

[52] U.S. Cl. ..... 226/97; 34/57 A

[58] Field of Search ..... 226/7, 97, 196; 34/57 R, 57 A, 156; 242/75.3, 76

[56] References Cited

U.S. PATENT DOCUMENTS

| | | | |
|---|---|---|---|
| 3,776,440 | 12/1973 | Frost et al. | 226/97 |
| 3,873,013 | 3/1975 | Stibbe | 226/97 |

*Primary Examiner*—Leonard D. Christian

*Attorney, Agent, or Firm*—James E. Nilles

[57] ABSTRACT

An air bar for floating a running web and having air discharge slot means through which pressurized air is directed against the web to support the web. Pressurized air is introduced into the central portion of the air bar and a separate passageway is formed along the side wall of the air bar and which places the center of the air bar in air delivering communication with the discharge slot means. Air flow straightening means is located in the separate air delivering passage and directs or guides the air to flow outwardly through the slot means and in a normal direction to the slot means, that is at right angles to the web in a transverse direction of the web to thereby dissipate cross machine momentum components of air movement which results in more uniform drying of the web across its width.

10 Claims, 14 Drawing Figures

HIGH VELOCITY WEB FLOATING AIR BAR HAVING AIR FLOW STRAIGHTENING MEANS FOR AIR DISCHARGE SLOT MEANS

BACKGROUND OF THE INVENTION

This invention pertains to web handling apparatus having air bars for floatingly suspending a running web and drying the ink or other material on the web without permitting the web to touch any supporting surfaces. The invention is in the nature of an improvement over the U.S. Pat. No. 3,549,070 which issued Dec. 22, 1970 to Frost et al and entitled "Floatation of Sheet Materials;" U.S. Pat. No. 3,873,013 which issued Mar. 25, 1975 to Paul H. Stibbe and entitled "High Velocity Web Floating Air Bar having Center Exhaust Means;" and U.S. Pat. No. 3,964,656 which issued June 22, 1976 to Terry A. Hella and entitled "Air Bar Assembly for Web Handling Apparatus," all of which patents have been assigned to an assignee common with the present invention.

In web drying equipment of the type exemplified by the above United States patents and others, pressurized air is introduced into the interior of the air bar and is then generally permitted to issue directly through the air discharge slots of the air nozzles and against the web. These arrangements often resulted in non-uniform drying of the web across its width because the air was discharged from the slots in directions other than right angles to the transverse width of the web and these cross machine momentum components of air movement resulted in such uneven drying of the web.

Certain air bars of the prior art were not entirely satisfactory in that difficulty was experienced in maintaining a precise width for the slot gap of the nozzle due to the problems in rigidly supporting the lip or nozzle edge adjacent the slot and preventing it from bending or otherwise becoming misaligned.

SUMMARY OF THE INVENTION

The present invention provides an elongated and generally tubular air bar which is adapted to be positioned closely adjacent to a running web for supporting the web on a cushion of pressurized air. The air bar includes transversely positioned air discharge slot means across the web to which pressurized air is fed from a central chamber of the air bar and through separate air delivering passageways in the air bar. Air flow straightening means are located in the passageways and are positioned transversely therein with respect to the elongated air bar whereby pressurized air which is directed into the central chamber of the air bar then enters the passageways and the air flow is straightened and guided by the straightening means so as to assume a normal direction of flow to the air discharge slot means. Thus the air which is introduced into the air bar is caused to pass the straightening means before it is discharged through the slots and thereby the cross machine momentum components of air movement are dissipated which results in the discharge of air through the slot means at right angles to the web in a transverse direction of the web.

One aspect of the invention provides an air bar of the above type in which the air straightening means are formed as flutes pressed into an inner wall and which flutes extend closely adjacent the lip or nozzle edge of the air slots to rigidify the latter and support it in its proper position to thereby insure a uniform gap for the air discharge slot. Another aspect of the invention relates to the air straightening means being formed as a series of elongated strips welded or otherwise secured to an inner wall of the air bar.

These and other objects and advantages of the present invention will appear hereinafter as this disclosure progresses, reference being had to the accompanying drawings.

DESCRIPTION OF A PREFERRED EMBODIMENT

Figure 1:
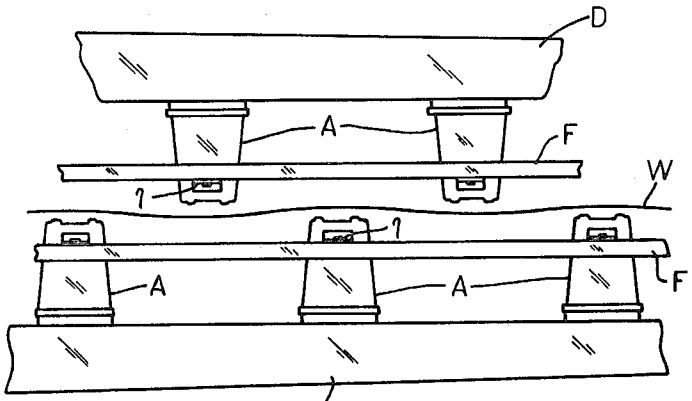
FIG. 1 is a schematic, side elevational view of a plurality of air bars made in accordance with the present invention and conventionally arranged on opposite sides of a running web and in staggered relationship to one another from one side of the web to the other.
Figure 3:
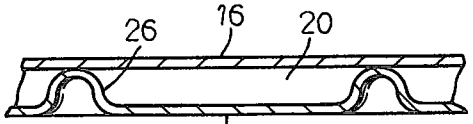
FIG. 3 is a cross sectional view taken generally along the line 3—3 in FIG. 2 and showing the flow straightening means.

A general organization of a plurality of air bars made in accordance with the present invention is shown in FIG. 1, the air bars A being secured by brackets 1 to the frame F of the machine with which they are used. The air bars are secured to a duct D in the conventional manner, for example as shown in the U.S. Pat. No. 3,739,491 of June 19, 1973 which issued to Creapo et al and entitled "High Velocity Air Web Dryer" or as shown in the said U.S. Pat. 3,873,013. It is believed sufficient to say that pressurized air is fed from the duct via opening 3 in the inner side 3*a* of the air bar and into the central chamber 4 of the generally tubular and elongated air bar A.

Figure 2:
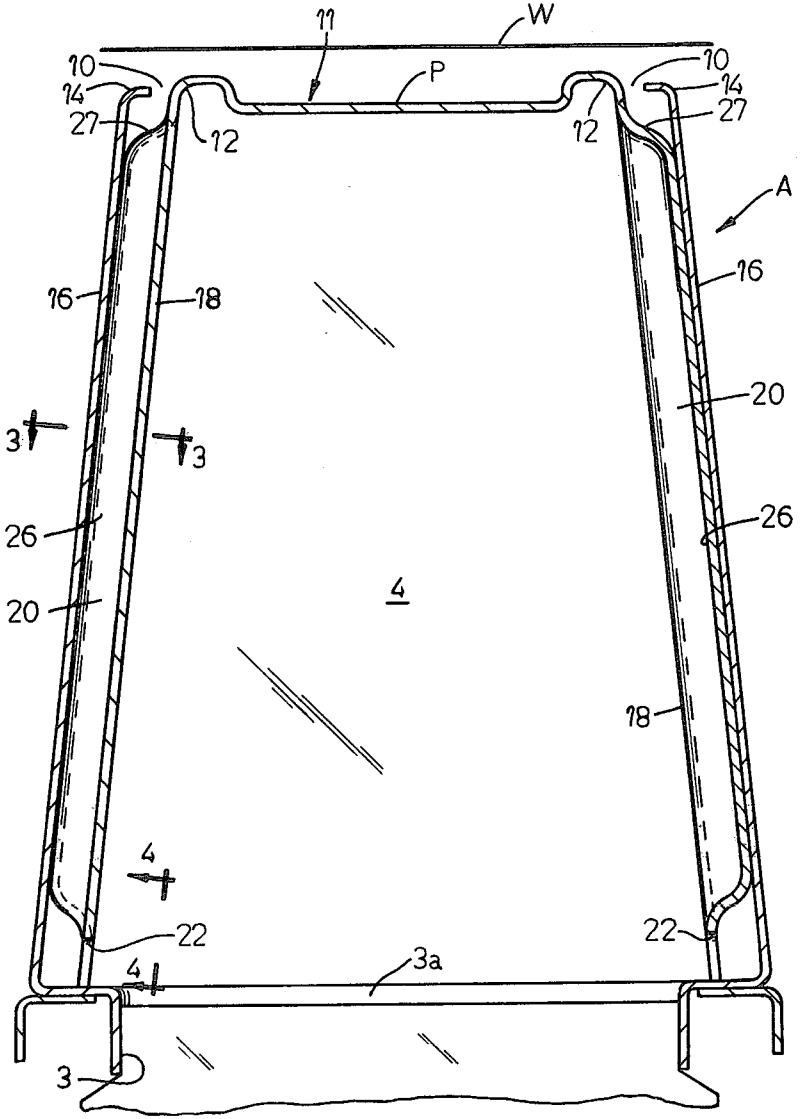
FIG. 2 is an enlarged, cross sectional view through one of the air bars made in accordance with the present invention.
Figure 4:
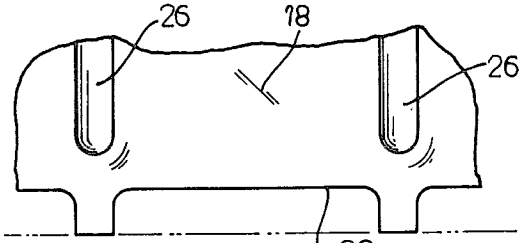
FIG. 4 is a view taken generally along the line 4—4 in FIG. 2.
Figure 5:
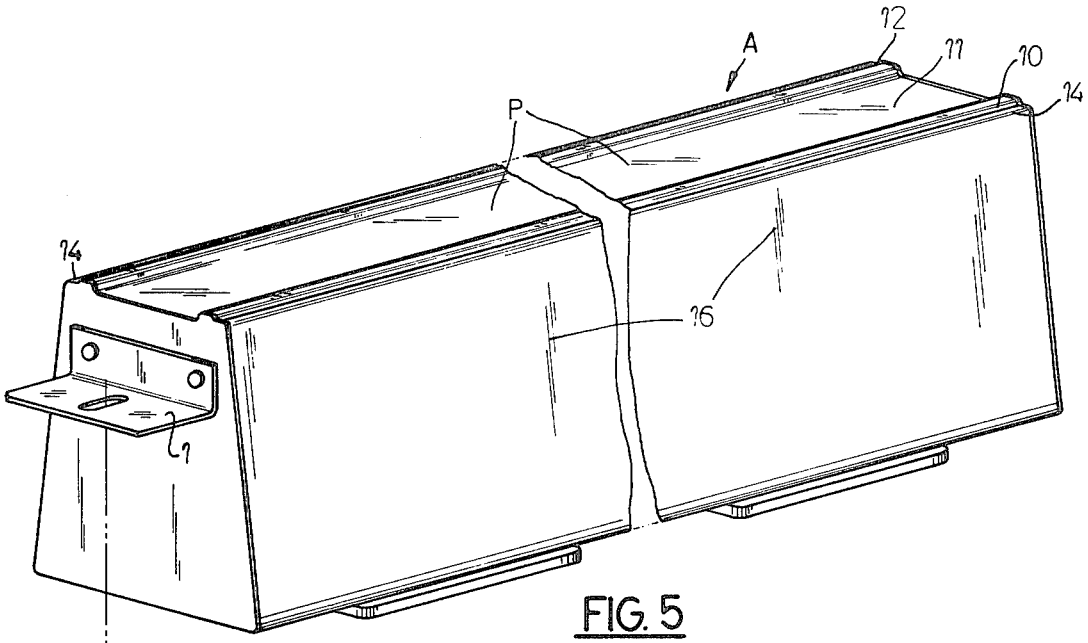
FIG. 5 is a perspective view of the air bar shown in FIG. 2, but on a reduced scale.
Figure 6:
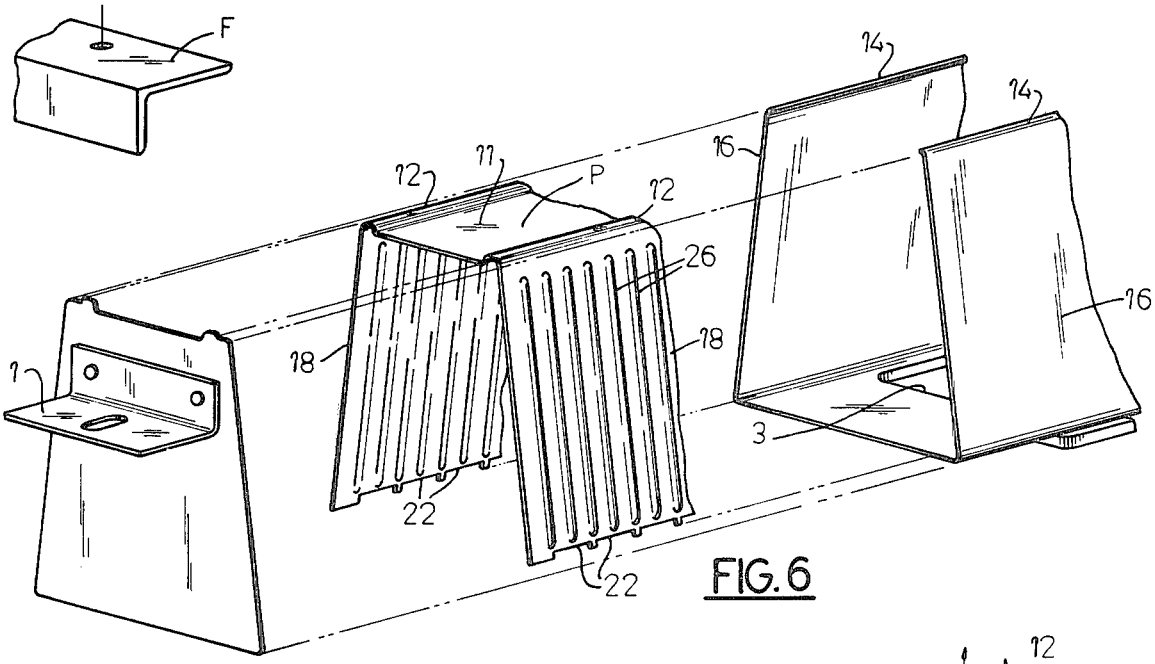
FIG. 6 is a fragmentary view of the FIG. 5 air bar but showing certain of the parts in an exploded position.
Figure 7:
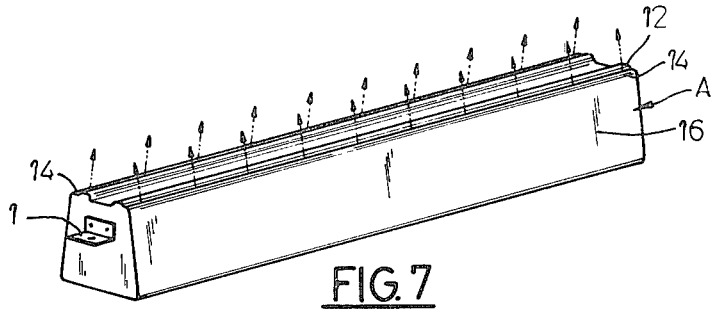
FIG. 7 is a perspective view of the air bar shown in FIG. 5 but on a reduced scale and showing the general direction of air movement as the air is discharged from the nozzle slots.

The air bar A is positionable closely adjacent the running web W for supporting the web on a cushion or zone of pressurized air that is developed between the air bar and the web. The air bar includes air discharge slot means as shown in FIG. 2, in the form of a pair of spaced apart air discharge slots 10 located generally in the outer side 11 of the air bar. These slots extend transversely across the web W. Located between the slots is a plate P having rounded corners or edges 12 that define one side of the air nozzle. The other side of the air discharge slots 10 is formed by a nozzle edge or lip 14 which extends closely adjacent the curved edge 12 but terminates short of it to define the slot 10. The lip 14 forms the upper portion of the side walls 16, two such side walls being utilized in the FIG. 2 showing. The air bar also includes inner wall means 18 located adjacent to but spaced from and in general parallelism with each of the outer side walls 16. In this manner the walls 16 and 18 together define a separate air delivering passageway 20 along each side of the air bar and which passageway communicates with the central chamber 4 via openings 22 (FIGS. 2, 4 and 6) and the passageway also communicates with the air discharge slots 10 at the outer end of the air bar.

Formed within the air delivering passageway 20 are air flow straightening means which in the FIGS. 2 to 6 modification are formed by elongated raised portions or flutes 26 that are pressed into the inner wall means 18. It will be noted that the upper end 27 (FIG. 2) of the flutes terminates a short distance from the lip 14 on the nozzle thereby providing a rigid structure and a good support for the overhanging lip of the nozzle. This results in maintaining the discharge slots of constant width and this slot gap is easier to maintain in practice than conventional air bars. The short support span for the lip of the nozzle is thus possible because the flutes can be extended closely adjacent the discharge slot.

The outer walls 16 are rigidly secured to the flutes, for example as by spot welding, thus forming a rigid structure which is economical to manufacture and the shape of the air bar and straighteners thereof can be maintained.

Figure 10:
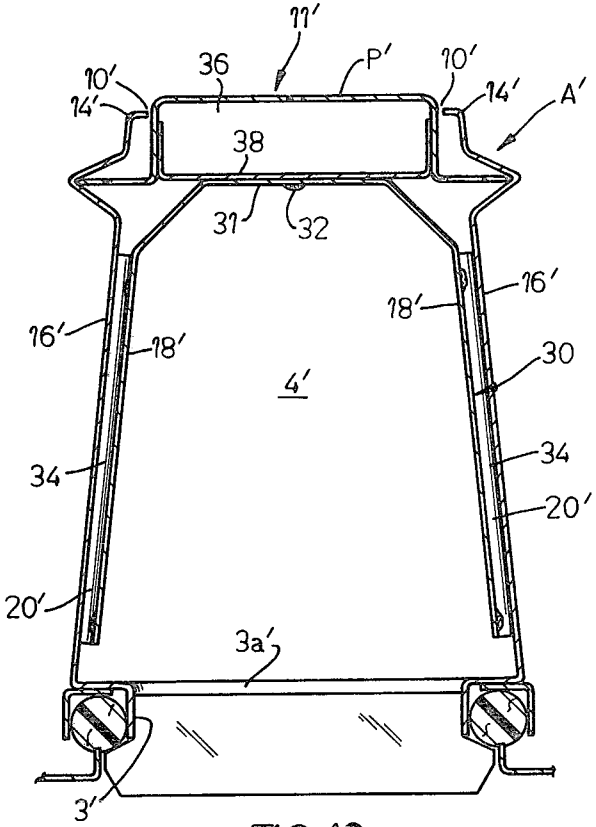
FIG. 10 is a cross sectional view of another modified form of air bar illustrating the present invention.
Figure 8:
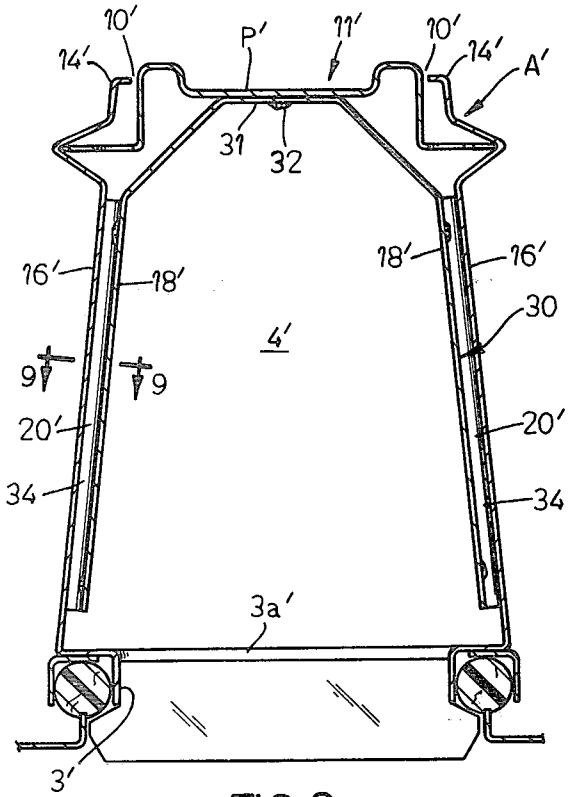
FIG. 8 is a view similar to FIG. 2, but showing a modified form of air bar utilizing the present invention.
Figure 9:
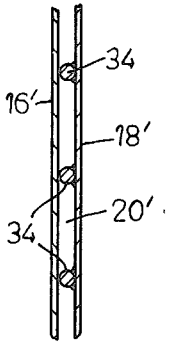
FIG. 9 is a sectional view taken along line 9—9 in FIG. 8.
Figure 11:
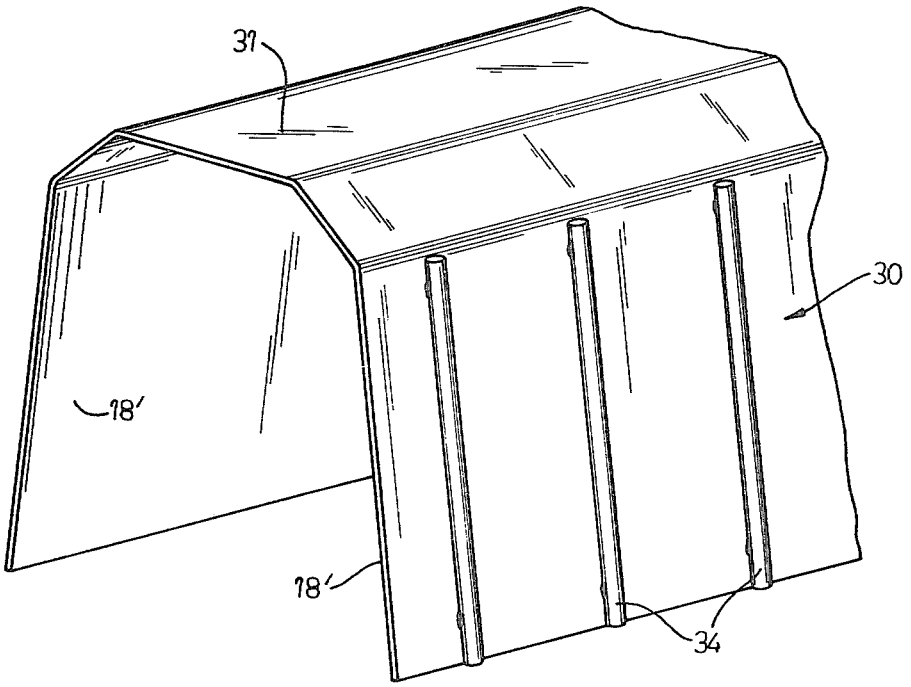
FIG. 11 is a perspective, fragmentary view of an insert for conventional air bars and as utilized in the air bars of FIGS. 8 and 10, the insert having a modified form of flow straightening means secured thereto.

The modification shown in FIGS. 8 and 10 have been numbered similarly to the FIG. 2 showing with the exception of a prime (') being added to the reference numerals. The general organization and operation of these modifications is the same as the FIG. 2 showing as far as the air flow straightening feature is concerned. In the FIGS. 8 and 10 modification the inner walls 18' are formed by the generally U-shaped, elongated metal insert structure 30 shown in FIG. 11 which extends co-extensively in length with the air bar. The bight portion 31 of the member 30 can be spot welded as at 32 to the intervening plate P' located between the discharge nozzle 10' as shown in FIG. 8. In this embodiment the air flow straightening means is formed by a series of elongated strips 34, such as metal rods which may be secured as by welding to the inner wall 18' at spaced apart locations thereon and in general parallelism with one another.

The modification shown in FIG. 10 may be an air bar of the type shown in the said U.S. Pat. No. 3,873,013 or in the said U.S. Pat. 3,964,656 and which include an air return chamber 36 that is defined in part by a lower wall member 38. In this embodiment the bight portion 31 of member 30 is spot welded at 32 to the member 38.

Figure 12:
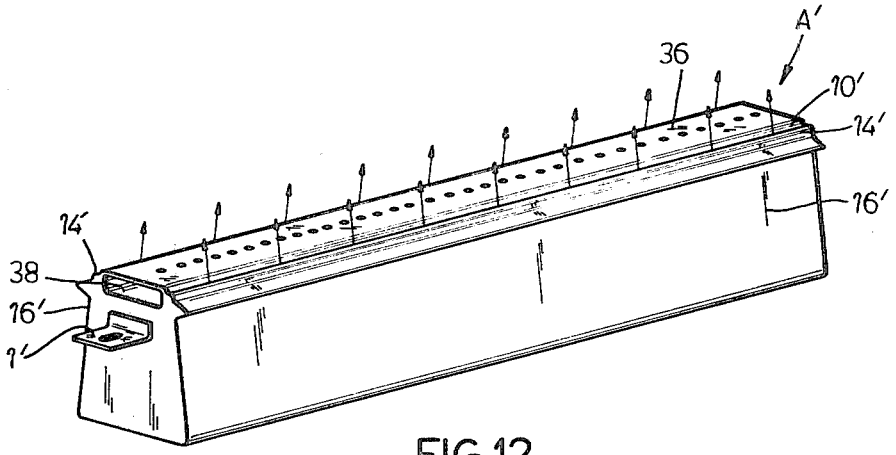
FIG. 12 is a perspective view of the air bar shown in FIG. 10, but on a reduced scale and showing the general direction of air movement as the air is discharged from the nozzle slots.

FIG. 12 shows the air bar of FIG. 10 and more particularly the flow of air through the slots and in a normal direction to the slots and at right angles to the web in a transverse direction of the web.

Figure 13:
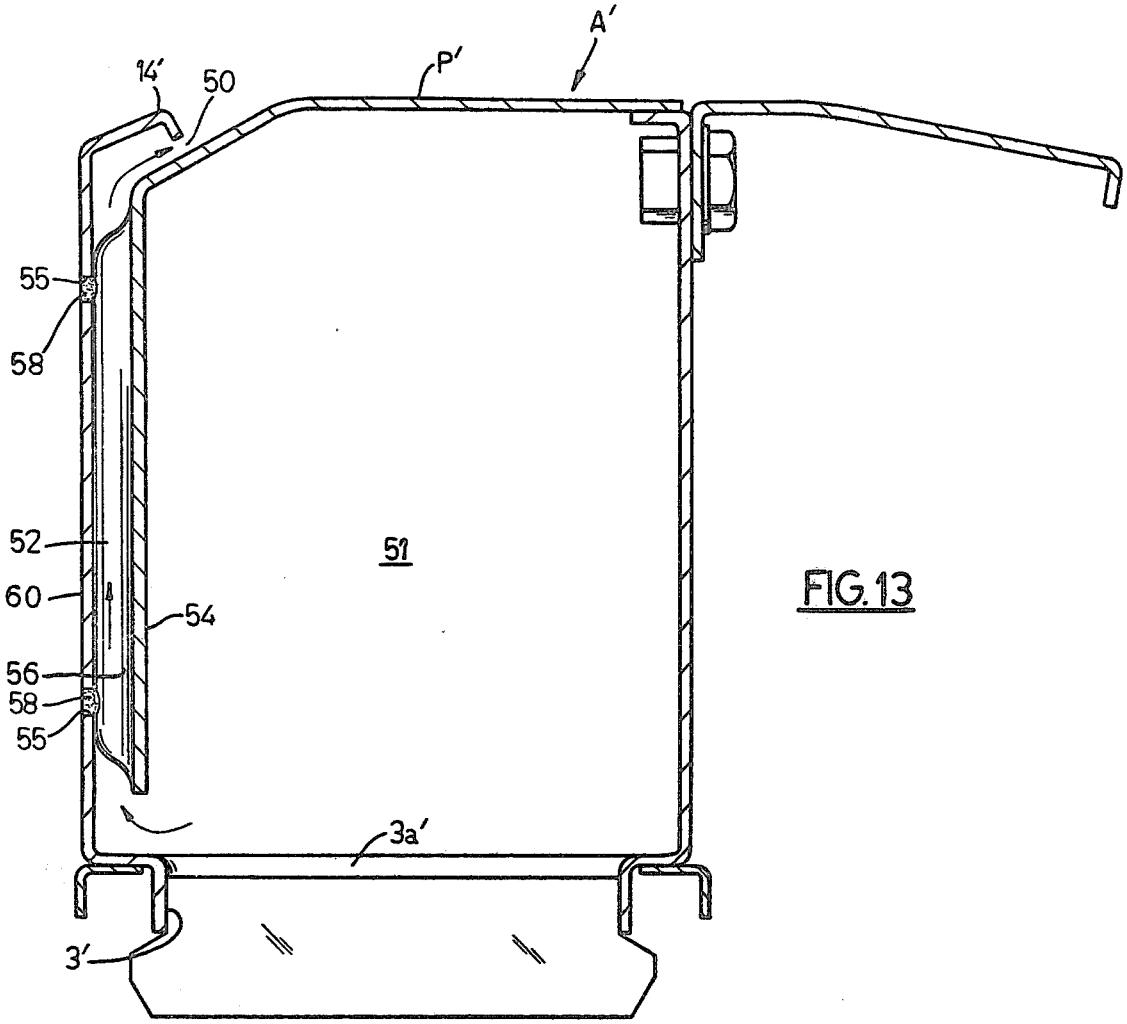
FIG. 13 is a cross sectional view through a modified air bar having a single air slot embodying the invention.
Figure 14:
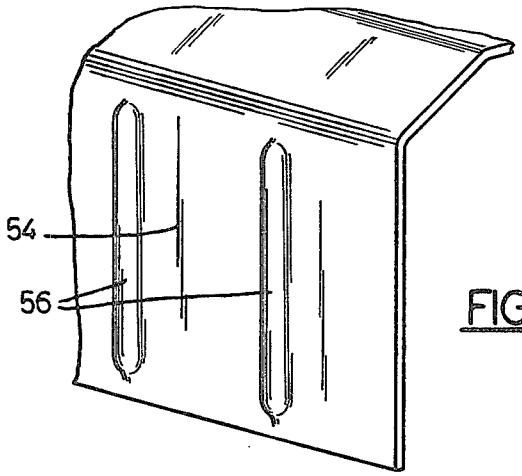
FIG. 14 is a fragmentary, perspective view of the fluted member which forms the inner wall of the air passageway 52, and also the air foil top or face P', as shown in FIG. 13.

The modified single slot air bar shown in FIGS. 13 and 14 has parts similar to those shown in the other figures, but includes only a single air discharge slot 50 from which pressurized air is delivered from the pressurized central chamber 51 and through the air delivering passageway 52, as indicated by the arrows in FIG. 13. The inner wall 52 has flutes 56, formed in its vertical portion. The inner wall 54 is welded to outer wall 60 through holes 55 in the outer wall as at 58, thus forming compartmented air passageways 52.

The present invention creates a precisely straight flow of air normally from the discharge air plate which results in uniform drying of the web across its width and elimination of angularity of flow from the slots which would adversely effect heat transfer uniformity.

I claim:

1. An elongated air bar for being positioned transversely of and adjacent to a running web for supporting said web and comprising, an outer side adapted to be positioned closely adjacent said web, an inner side having means communicating with an air supply, and two opposite and spaced apart side walls, said bar having an interior into which pressurized air is conducted, an air discharge slot located along said outer side, air flow straightening means located in said air bar and positioned normal to said slot and also generally normal to said outer side whereby air which is directed into said air bar interior is guided by said straightening means in a generally normal direction to said slot and to said outer side to thereby dissipate cross machine momentum components of air movement and consequently result in the discharge of said air through said slot at right angles to said web in a transverse direction thereof.

2. An elongated air bar for being positioned transversely of and adjacent to a running web for supporting said web and comprising, an outer side adapted to be positioned closely adjacent said web, an inner side having means communicating with an air supply, and two opposite and spaced apart side walls which together with said outer and inner sides define a pressurizable central chamber into which pressurized air is conducted, an air discharge slot located along said outer side, said slot being defined by said outer side and one of said side walls, and inner wall means located along and adjacent to, but spaced inwardly from said one of said side walls to thereby define therewith an air delivering passageway to said slot, said passageway being in air receiving communication with said central chamber for receiving pressurized air therefrom, air flow straightening means located in said passageway and positioned transversely therein with respect to said elongated air bar assembly and also positioned generally normal to said outer side whereby air which is directed into said central chamber then enters said passageway and is guided in a generally normal direction to said slot and to said outer side to thereby dissipate cross machine momentum components of air movement and consequently result in the discharge of said air through said slot at generally right angles to said web in a transverse direction thereof.

3. The assembly set forth in claim 2 further characterized in that said air flow straightening means are formed as flutes pressed into said inner wall means.

4. The assembly set forth in claim 2 further characterized in that said air flow straightening means comprise elongated strips secured to said inner wall means at spaced apart locations thereon and in general parallelism with one another.

5. An elongated and generally tubular air bar adapted to be positioned closely adjacent a running web for supporting said web on a cushion of air, said air bar defining a pressurizable central chamber into which pressurized air is conducted and having means communicating with a pressurized air supply, said bar having spaced apart air discharge slots located adjacent said web and for transmitting pressurized air therethrough to form said air cushion, and separate air delivering passageways in said bar and communicating with said slots and also in air receiving communication with said central chamber for receiving pressurized air therefrom, and air flow straightening means located in said passageways and positioned transversely therein with respect to said elongated air bar whereby air which is directed into said central chamber then enters said passageways and is guided by said straightening means in a normal direction to said slots to thereby dissipate cross machine momentum components of air movement and consequently result in the discharge of said air through said slots at right angles to said web in a transverse direction thereof.

6. The assembly set forth in claim 5 further characterized in that said air bar includes a pair of spaced apart side walls, and inner wall means located along and adjacent to, but spaced inwardly from said side walls to thereby define therewith said air delivering passageways to said slots, and said flow straightening means are formed as flutes pressed into said inner wall means.

7. The assembly set forth in claim 5 further characterized in that said air bar includes a pair of spaced apart side walls, and inner wall means located along and adjacent to, but spaced inwardly from said side walls to thereby define therewith said air delivering passageways to said slots, and said flow straightening means comprise elongated strips secured to said inner wall means at spaced apart locations thereon and in parallelism with one another.

8. An elongated air bar assembly for being positioned transversely of and adjacent to a running web for supporting said web on a cushion of air, said elongated assembly comprising, an outer side adapted to be positioned closely adjacent said web, an inner side having means communicating with an air supply, and two opposite and spaced apart side walls which together with said outer and inner sides define a pressurizable central chamber into which pressurized air is conducted, an air discharge slot located along each longitudinal edge of said outer side, said slots being defined by said outer side and said side walls, and inner wall means located along and adjacent to, but spaced inwardly from said side walls to thereby define therewith air delivering passageways to said slots, said passageways being in air receiving communication with said central chamber for receiving pressurized air therefrom, air flow straightening means located in said passageways and positioned transversely therein with respect to said elongated air bar assembly whereby air which is directed into said central chamber then enters said passageways and is guided in a normal direction to said slots to thereby dissipate cross machine momentum components of air movement and consequently result in the discharge of said air through said slots at right angles to said web in a transverse direction thereof.

9. The assembly set forth in claim 8 further characterized in that said air flow straightening means are formed as flutes pressed into said inner wall means.

10. The assembly set forth in claim 8 further characterized in that said air flow straightening means comprise elongated strips secured to said inner walls means at spaced apart locations thereon and in general parallelism with one another.

* * * * *